US005445384A

United States Patent [19]

Yancey

[11] Patent Number: 5,445,384

[45] Date of Patent: Aug. 29, 1995

[54] GOLF TRAINING DEVICE

[75] Inventor: Drew A. Yancey, Scottsdale, Ariz.

[73] Assignee: Southwest AES Inc., Scottsdale, Ariz.

[21] Appl. No.: 141,080

[22] Filed: Oct. 26, 1993

[51] Int. Cl.[6] ..... A63B 69/36

[52] U.S. Cl. ..... 273/188 A; 273/187.2; 273/187 B; 36/127

[58] Field of Search ..... 273/187.2, 188 R, 188 A, 273/187 B; 36/127, 132

[56] References Cited

U.S. PATENT DOCUMENTS

| | | | |
|---|---|---|---|
| 1,876,195 | 9/1932 | Youmans | 36/127 |
| 3,218,734 | 11/1965 | O'Brien . | |
| 3,951,407 | 4/1976 | Calacurcio | 36/127 |
| 4,073,075 | 2/1978 | O'Brien . | |
| 4,081,918 | 4/1978 | O'Brien . | |
| 4,118,034 | 10/1978 | O'Brien . | |
| 4,145,055 | 3/1979 | O'Brien | 36/127 |
| 4,364,564 | 12/1982 | Lewis | 273/187.2 |
| 4,407,079 | 10/1983 | Chiroff . | |
| 4,407,506 | 10/1983 | O'Brien . | |
| 4,819,940 | 4/1989 | Davis . | |
| 4,875,683 | 10/1989 | Wellman et al. . | |

FOREIGN PATENT DOCUMENTS

| | | | |
|---|---|---|---|
| 1128009 | 1/1957 | France | 36/132 |

*Primary Examiner*—Mark S. Graham
*Attorney, Agent, or Firm*—Foley & Lardner

[57] ABSTRACT

A golf training device including a hemispherical body adapted to be secured to the shoe sole of the user. The body is positioned laterally intermediate the sides of the shoe generally in the region of the ball of the foot. The body tends to elevate the front of the foot thereby shifting weight somewhat to the heel of the foot. During the backswing and downswing, the body rolls over the ground and magnifies the feeling resulting from the shifting of weight during the backswing and downswing. The device is retained in place by straps which extend over the top of the shoe and which can be secured by Velcro strips.

7 Claims, 1 Drawing Sheet

GOLF TRAINING DEVICE

BACKGROUND OF THE INVENTION

The present invention relates as indicated to a golf training device, and relates more particularly to a device which facilitates training and recognition of the proper rolling movement of the feet during the swinging of a golf club, particularly the desired rolling movement of the forward foot, that is, the foot of the golfer closest to the target when the ball is being addressed.

It is universally recognized that in developing an effective golf swing, proper movement of the feet and legs is at least as important as the swinging of the arms and the upper body. The legs provide the body with the necessary balance during the swing, and in order to maximize distance or power, it is necessary that the legs accommodate a proper shift of body weight first to the back leg and foot and then to the leg and foot closest to the target. For right-handed golfers, the left foot is the foot which is closest to the target when the golfer is in a properly addressed position to hit the golf ball.

Detailed knowledge of the fundamentals of the golf swing is not necessary in order to fully understand the concepts of the present invention. However, to better understand and appreciate the advantages of the invention, a basic understanding of leg and foot movement during the golf swing is helpful. When the golfer addresses a ball to make a full swing with an iron or a wood, the feet are spread, the knees are slightly bent, and weight is distributed generally equally between both feet. As a general guide, the feet are normally placed no wider apart than the width of the shoulders, and the position of the ball between the feet varies somewhat depending upon the club used. For woods and long irons, the ball is generally positioned closer to the forward foot, with the ball being moved rearwardly toward the rear foot as the irons become shorter.

For a right-handed golfer, as the club is moved away from the ball at the position of address to begin the backswing, the left foot tends to roll onto the instep of the foot and the weight settles onto the inside of the right foot. At the start of the downswing, the left foot rolls in the opposite direction or toward the target, and at the same time there is a general pushing off with the rear or right foot. The rolling of the left or forward foot toward the target forces the forward knee outward, which begins the counterclockwise rotation of the hips, which in turn pulls the shoulders and arms through the impact zone. At the time of impact, the weight is generally transferred entirely from the rear or right foot to the outside of the left foot.

The proper shifting of weight is absolutely essential to maximize the force generated during the swing, and the rolling motion of the left or forward foot is very important. The proper shifting of body weight is first rearwardly during the backswing, and then forwardly during the downswing. At the same time, the head and body remain in place, with the upper body effectively rotating around an axis through the spine.

Various training devices have been developed for the golfer to get a better feel for the proper weight distribution on the feet during the full swing. One such device constitutes a roll bar which can be attached to the bottom outside edge of the shoe of the golfer which is closest to the target. Although the curved bottom surface of the roll bar facilitates rolling movement of the shoe, its placement along one edge of the shoe tends to cant the shoe which can inhibit weight distribution during setup or address. Moreover, since the device is intended to be worn during play and not just during practice or training, the roll bar is necessarily relatively shallow in height and therefore somewhat limited in effectiveness.

There are numerous training devices which are adapted to be attached to shoes on the rear foot of the golfer, that is, the foot farthest from the target. The purpose of these is to cant or tilt the foot forward or toward the target, which helps the golfer stay over the ball during the swing. This is intended to cure undesirable sway during the golf swing, which is a particular problem with new and high handicap golfers. By tilting the right foot, and consequently the body, forward sway is inhibited. Such devices are also designed to reduce the likelihood of the golfer transferring all of his weight to the rear foot during the initial phase of the swing, and to help with weight shift during the swing. However, since these devices are on the rear foot they are unable to simulate the proper rolling movement of the front foot during the backswing and downswing.

SUMMARY OF THE INVENTION

The purpose of the invention is to aid the golfer in slightly tilting back the front foot during set up or address, and facilitating the initiation of weight shift to the rear foot during the backswing. This allows the hips to rotate around the spinal axis so that a greater swing arc can be achieved. On the downswing, the invention permits the user to roll the front foot toward the target thereby facilitating rotation of the hips around the spinal axis and movement of the left knee toward the target as the weight is shifted from the rear foot to the front foot. The invention permits the golfer to achieve a proper feeling of the desired rolling movement which most effectively transfers the weight to the front foot during the downswing thereby achieving greater power at impact.

In accordance with the invention, a generally hemispherically shaped device is attached to the sole of the shoe of the front foot (left shoe for right-handed golfers) of the golfer, generally intermediate the toe and the instep. The device is spaced generally midway between the side edges of the shoe so that during setup the device does not tend to tilt or cant the left foot either toward or away from the target. However, the position of the device in front of the instep serves to elevate the front of the shoe thereby shifting the weight to some extent toward the back of the foot. This tends to stabilize the body at the address position, without at the same time resulting in a flat-footed orientation which might adversely affect the proper golf swing.

The body of the device can be simply and quickly removably secured to the shoe. In one form, a strap is secured to the body of the device, and extends outwardly at both side edges of the sole and then upwardly over the top of the shoe just forwardly of the instep. The ends of the strap are provided with velcro for attachment to each other. The invention can thus easily accommodate a rather wide assortment of shoe sizes while still permitting a tight and secure attachment of the device to the shoe. In another embodiment, attachment means are provided on opposite sides of the device, to which the connecting straps can be secured. In this embodiment, Velcro fastening means are similarly preferred in order to provide effective locking while accommodating a wide variety of shoe sizes.

The training device of the present invention can be manufactured at very low cost and is particularly easy to use. The body of the device is preferably molded of any suitable rubber or plastic material, and in one embodiment the connecting strap can be embedded in the plastic body during the molding operation. In another embodiment, the straps are secured to connecting means at the opposite sides of the device.

A further advantage of the invention is its adaptability to a shoe regardless of the spike pattern on the bottom of the shoe. A single opening is formed in the generally flat or planer surface of the device disposed contiguous the sole, so that a single spike can be accommodated. Since spike patterns vary from shoe to shoe, the provision of a single central opening permits the device to be used regardless of spike patterns and with little deviation in terms of mounting location.

BRIEF DESCRIPTION OF THE DRAWINGS

In the application drawings.

DETAILED DESCRIPTION OF THE PREFERRED EMBODIMENTS

Figure 1:
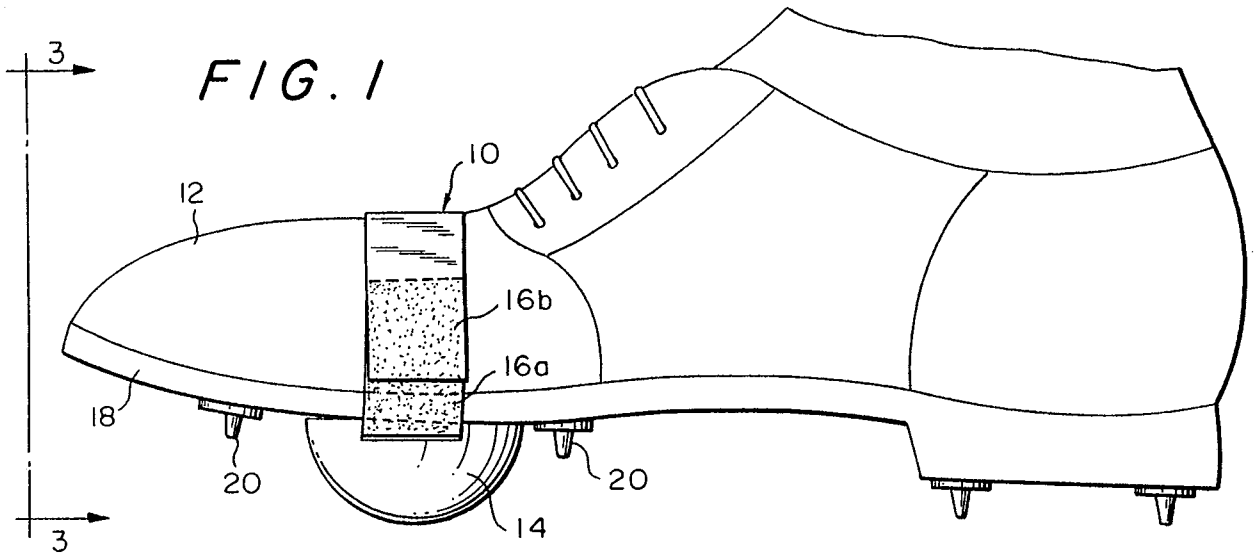
FIG. 1 is a side elevational view showing one embodiment of the invention attached to a shoe between the instep and the toe.
Figure 2:
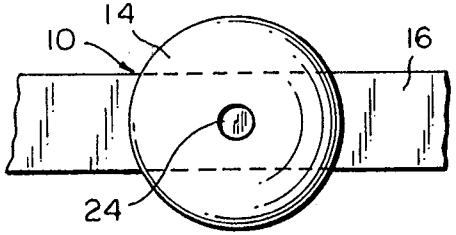
FIG. 2 is a fragmentary plan view of the training device and attached connecting strap.
Figure 3:
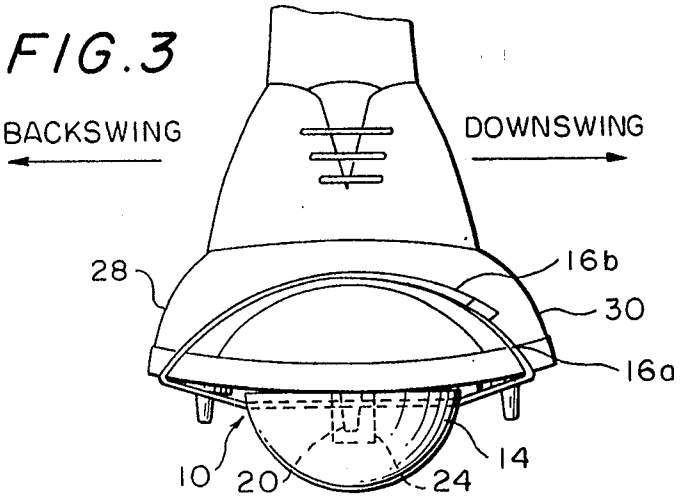
FIG. 3 is a front view of FIG. 1, taken on line 3—3 of FIG. 1.

Referring now in more detail to the application drawing, wherein like parts are indicated by like reference numbers, the training device in accordance with the FIGS. 1–3 embodiment of the present invention is generally indicated at 10 and is adapted to be mounted on the shoe 12 of the user just forwardly of the instep, as shown in FIG. 1. The device 10 comprises a generally hemispherical body 14 and a strap 16 secured to the body. Typically, the sole 18 of the shoe has spikes commonly designated at 20 tapped into threaded inserts provided therefor in the sole. Spike patterns vary from shoe to shoe, and the present invention is adaptable to any such spike pattern since it is constructed and arranged to receive a single spike when secured in place, and is not critically dependent as to a precise location when mounted.

As shown in FIG. 1, the device is preferably mounted just forwardly of the instep portion of the shoe, with the hemispherical body 14 preferably being located approximately midway between the opposed side edges of the sole. When so centrally located, there is no tendency for the body 14 to cause the foot of the user to tilt or cant in either lateral direction. Thus, the user can take his or her natural stance, with the body 14 serving at that point only to slightly elevate the front of the shoe relative to the heel. This tends to push the weight back slightly to the heel portion of the foot, thereby stabilizing the body during the setup or address position.

In the FIGS. 1–3 embodiment, the strap 16 is embedded in the body 14 during the formation of the body, preferably by conventional molding techniques. The strap extends from either side of the body and can be wrapped upwardly over the top of the shoe and tightened. The strap portion designated **16*a* is preferably formed with Velcro on its top, exposed surface, and the opposite strap end designated 16*b* is formed with Velcro on its undersurface. When the strap end 16*b*** is pulled tight over the top of the shoe there is an overlapping of the areas of Velcro by means of which the straps can be fastened in their adjusted positions.

As shown in FIG. 2, an opening 24 is formed in the body 14 either during or subsequent to the molding operation, with the opening also extending through the embedded strap 16. The opening 24 is sufficiently large in diameter to receive a spike 20 as shown in FIG. 3. In the mounting of the body on the sole of the shoe, the flat portion of the body disposed contiguous the shoe is moved until the opening 24 is aligned with the spike, and the body retained in that position while the straps are tightened and fastened. The precise positioning of the body 14 is not critical, and the provision of a single receiving opening permits the device to be installed on the bottom of any golf shoe regardless of spike pattern. The spike does serve the purpose of preventing lateral and longitudinal shifting of the body 14 and in that respect supplements the retention provided by the Velcro fasteners.

In use, the training device is attached to the forward foot as shown in FIGS. 1 and 3. When the user is taking his or her normal setup or address position, the body 14 shifts the weight generally to the heel of the forward foot, but due to its location generally midway between the side edges, the body does not tend to cause canting or tilting of the foot in either lateral direction.

During the backswing, the left or forward foot for a right-handed golfer tends to roll or rotate inward or to the left as shown by the arrow in FIG. 3. Such movement is facilitated by the shape and location of the body 14. At the height of the backswing, the weight has substantially shifted to the instep of the rear foot (not shown in the application drawing), and any weight on the left or forward foot shown in FIG. 3 settles onto the inside of the foot as generally shown at 28 in FIG. 3.

During the downswing, the rolling motion is reversed and weight is gradually shifted from the inside area 28 of the foot to the opposite outside region of the foot, shown at 30. During this weight shifting, the upper body portion is rotating about the spinal axis, and the hips are moving laterally through the impact area. The shape of the body 14 permits the user to get a better, more magnified feel of the rolling movement during the backswing and downswing during use of the training device. After repeated use, muscle memory is retained and better weight shifting is produced during actual play.

The body 14 of the FIGS. 1–3 embodiment is preferably of solid one-piece construction and molded of a suitable material such as rubber or plastic. The strap 16 can be formed of any suitable material, for example nylon webbing, to which layers of Velcro are added as described.

Figure 4:
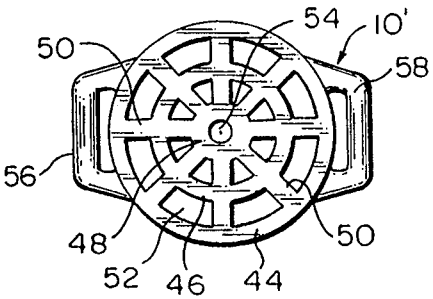
FIG. 4 is a top plan view of a modified device constructed in accordance with the present invention.
Figure 5:
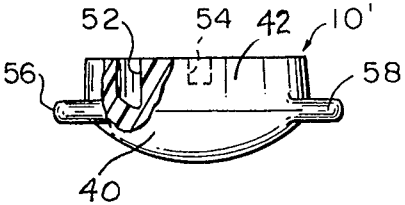
FIG. 5 is a side elevational view of the modification of FIG. 4.

FIGS. 4 and 5 illustrate an alternative embodiment of the invention in which the training device generally indicated at 10' is also molded and made of a suitable plastic material. The device is formed with a curved bottom wall 40 and a generally cylindrical upper portion 42. The latter is formed during molding with radially spaced concentric segments 44, 46, and 48, and spaced spoke-like connecting webs commonly designated at 50. The concentric rings and connecting webs define therebetween openings or depressions, for example, opening 52 between the rings 44 and 46 and shown in FIG. 5. The rings and connecting webs provide the necessary strength with a minimal amount of material. A center opening 54 is formed during the molding process, comparable to opening 24 in the FIGS. 1–3 embodiment, for receiving a spike when the device is mounted.

A pair of opposed ears 56 and 58 are formed at the sides of the device, for the purpose of receiving a strap or straps for retaining the device on the foot in the manner previously described and illustrated. Preferably, Velcro strips are applied to the strap at appropriate locations on the strap. For example, if a single strap is employed the opposite ends can be extended through the openings provided by the ears 56 and 58 and then secured by areas of Velcro provided on both sides of the strap near the ends thereof. If two straps are used, each strap similarly will be secured to the device in the regions of the ears, and fastened at the adjacent ends thereof in much the same manner as shown in FIG. 1. The strap or straps can be combined with one or more buckles to facilitate tightening of the device, with the precise construction of the strap not being critical to the practice of the invention.

The use of the FIGS. 4–5 embodiment is similar to that previously described. The body is located approximately centrally and the opening 54 is aligned with the adjacent spike in that area. A strap or straps are then tightened and secured to firmly engage the body contiguous the sole of the shoe in much the same manner as shown in FIG. 3. If two straps are provided, the opposite ends of each strap can be presecured through the ears 56 and 58, respectively, with the free ends being pulled to securely tighten when overlapped. When secured in place, the FIGS. 4–5 embodiment functions in the same manner as previously described.

It will thus be seen that the invention in both forms provides an inexpensive training device which can be quickly and easily secured to the shoe during use. By elevating the foot in the region where the training device is installed on the bottom of the shoe sole, an enhanced feeling of the weight shift which occurs during the swing is achieved. If proper weight shift is supervised by professional instruction, the proper weight shift can be repeated and mastered.

Any suitable material can be used to manufacture the training device, consistent with the described functions. Rubber has proved highly satisfactory where the device is solid as shown in FIGS. 1–3. The plastic material Santoprene has proved highly effective in the manufacture of the training device illustrated in FIGS. 4–5, although it will be understood that other suitable plastics could be used as well.

What is claimed is:

1. A golf training device for creating proper transfer of weight from the forward foot closest to the target to the rear foot during the backswing and back to the forward foot during the downswing, comprising:

a body at least one part of which is generally hemispherical and has a diameter, and a further, generally opposite part which is generally flat, said flat part being coextensive in dimension with said diameter of said hemispherical part, said flat part being adapted to engage the shoe sole of a user of the device intermediate the sides of the shoe and generally in the region of the ball of the forward foot of the user, the hemispherical part of said device adapted to engage the ground and provide a curved surface which can roll over the ground during the backswing and downswing so as to magnify the feeling of weight shift from and back to the forward foot during the swing;

strap means attached to said body, said strap means being of sufficient length to extend upwardly over the top of the shoe and be pulled taut to firmly secure said body in its mounted position; and securing means provided on said strap means for maintaining said strap means in taut condition firmly securing the body in place.

2. The device of claim 1 wherein said strap means comprises a single strap molded to the body of said device, said strap having opposed lateral ends extending from the sides of the body and being of a length to extend upwardly over the top of the shoe with the ends overlapping.

3. The device of claim 2 wherein the ends of said strap at least in the region of overlapping are provided with Velcro on the contacting surfaces, whereby the ends can be maintained in their adjusted, overlapped condition.

4. The device of claim 2 wherein said body is molded and made of rubber.

5. The device of claim 1 wherein said generally flat part of said body is formed generally centrally therein with an opening adapted to receive a spike mounted on the underside of the shoe, the spike extending into said opening when the device is operably mounted, thereby preventing significant sliding movement of the device relative to the sole of the shoe.

6. The device of claim 1 wherein said body is of molded plastic material and provided with securing tabs at each side thereof for engagement by said strap means.

7. The device of claim 6 wherein at least the flat part of said body is formed of a series of concentrically arranged and radially spaced sections, and radially extending connecting webs extending between and secured to said concentric sections, and a central opening for receiving a spike mounted on the sole of the shoe.

* * * * *